US006797448B2

(12) United States Patent
Fields et al.

(10) Patent No.: US 6,797,448 B2
(45) Date of Patent: Sep. 28, 2004

(54) ELECTROPHOTOGRAPHIC TONER AND DEVELOPMENT PROCESS WITH IMPROVED IMAGE AND FUSING QUALITY

(75) Inventors: Robert D. Fields, Rochester, NY (US); Thomas J. Foster, Genesco, NY (US); Paul L. Nielsen, Lima, NY (US); Thomas A. Jadwin, Rochester, NY (US); Dinesh Tyagi, Fairport, NY (US)

(73) Assignee: Eastman Kodak Company, Rochester, NY (US)

( * ) Notice: Subject to any disclaimer, the term of this patent is extended or adjusted under 35 U.S.C. 154(b) by 6 days.

(21) Appl. No.: 10/138,840

(22) Filed: May 3, 2002

(65) Prior Publication Data

US 2003/0013032 A1 Jan. 16, 2003

Related U.S. Application Data

(60) Provisional application No. 60/290,691, filed on May 14, 2001.

(51) Int. Cl.[7] ..... G03O 15/09

(52) U.S. Cl. ..... 430/122; 430/106.1; 399/267

(58) Field of Search ..... 430/122, 106.1, 430/106.3; 399/267

(56) References Cited

U.S. PATENT DOCUMENTS

| | | | | |
|---|---|---|---|---|
| 2,229,513 A | | 1/1941 | Lustig et al. | 217/60 |
| 3,716,630 A | | 2/1973 | Shirk | 423/594 |
| 3,893,935 A | | 7/1975 | Jadwin et al. | 252/62.1 |
| 3,941,898 A | | 3/1976 | Sadamatsu et al. | 427/18 |
| 3,983,992 A | | 10/1976 | Gray et al. | 198/381 |
| 4,046,990 A | | 9/1977 | White | 219/471 |
| 4,076,857 A | | 2/1978 | Kasper et al. | 427/18 |
| 4,079,014 A | | 3/1978 | Burness et al. | 252/62.1 |
| 4,085,702 A | | 4/1978 | Consaul et al. | 118/60 |
| 4,160,644 A | | 7/1979 | Ryan | 23/230 B |
| 4,323,634 A | | 4/1982 | Jadwin | 430/110 |
| RE31,072 E | | 11/1982 | Jadwin et al. | |
| 4,385,823 A | | 5/1983 | Kasper et al. | 430/60 |
| 4,394,430 A | | 7/1983 | Jadwin et al. | 430/110 |
| 4,395,109 A | | 7/1983 | Nakajima et al. | 355/3 FU |
| 4,414,152 A | | 11/1983 | Santilli et al. | 260/185 |
| 4,416,965 A | | 11/1983 | Sandhu et al. | 430/109 |
| 4,473,029 A | | 9/1984 | Fritz et al. | 118/657 |
| 4,515,884 A | | 5/1985 | Field et al. | 430/99 |
| 4,546,060 A | | 10/1985 | Miskinis et al. | 430/108 |
| 4,624,907 A | | 11/1986 | Niimura et al. | 430/106 |
| 4,683,188 A | | 7/1987 | Suzuki et al. | 430/110 |
| 4,780,553 A | | 10/1988 | Suzuki et al. | 556/26 |
| 4,810,858 A | | 3/1989 | Urban et al. | 219/469 |
| 4,814,250 A | | 3/1989 | Kwarta et al. | 430/110 |
| 4,834,920 A | | 5/1989 | Bugner et al. | 260/201.15 |
| 4,840,864 A | | 6/1989 | Bugner et al. | 430/110 |
| 4,912,009 A | | 3/1990 | Amering et al. | 430/137 |
| 5,057,392 A | | 10/1991 | McCabe et al. | 430/109 |
| 5,089,547 A | | 2/1992 | McCabe et al. | 524/262 |
| 5,102,765 A | | 4/1992 | McCabe et al. | 430/110 |
| 5,112,715 A | | 5/1992 | DeMejo et al. | 430/109 |
| 5,147,747 A | | 9/1992 | Wilson et al. | 430/109 |
| 5,512,404 A | * | 4/1996 | Saha | 430/106.6 |
| 5,534,347 A | | 7/1996 | Chen et al. | 428/375 |
| 5,595,823 A | | 1/1997 | Chen et al. | 428/906 |
| 5,629,061 A | | 5/1997 | Kass | 428/35.8 |
| 5,780,195 A | | 7/1998 | Nava | 430/110 |
| 6,067,438 A | | 5/2000 | Chen et al. | 399/325 |
| 6,096,429 A | | 8/2000 | Chen et al. | 428/421 |
| 6,253,055 B1 | * | 6/2001 | Badesha et al. | 399/324 |
| 6,589,703 B2 | * | 7/2003 | Stelter et al. | 430/122 |
| 2002/0115006 A1 | * | 8/2002 | Jadwin et al. | 430/106.1 |

FOREIGN PATENT DOCUMENTS

| | | | |
|---|---|---|---|
| EP | 1420839 | 9/1979 | C08J/3/02 |
| GB | 3905 | 1/1976 | C08K/5/19 |
| GB | 1501065 | 2/1978 | G03G/9/08 |

* cited by examiner

*Primary Examiner*—John L Goodrow

(57) ABSTRACT

Development systems and methods for developing using toner are disclosed. The present invention further discloses developers used in development systems. With respect to the development system, a development system is disclosed which includes a supply of dry developer mixture which contains toner particles and hard magnetic carrier particles. The development system further includes a non-magnetic, cylindrical shell for transporting the developer between the supply and the development zone, wherein the shell can be rotatable or stationary. A rotating magnetic core of a pre-selected magnetic field strength and means for rotating at least the magnetic core to provide for the transport of the toner particles from the shell to an electrostatic image also provided as part of the development system. The development system of the present invention further includes a fuser roll which is coated with a silicone rubber or other low surface energy elastomer or resin. The fuser roll is preferably in a pressure contact arrangement with a backup or pressure roll. The images resulting from the development system of the present invention have an excellent combination of properties, in particular, the prints resulting from the development process of the present invention have improved image quality in combination with excellent fusing quality. A method for developing electrostatic images with toner is further disclosed, for example, involving the above-described development system.

26 Claims, No Drawings

ELECTROPHOTOGRAPHIC TONER AND DEVELOPMENT PROCESS WITH IMPROVED IMAGE AND FUSING QUALITY

This application claims the benefit under 35 U.S.C. §119(e) of prior U.S. Provisional Patent Application No. 60/290,691 filed May 14, 2001, which is incorporated in its entirety by reference herein.

BACKGROUND OF THE INVENTION

The present invention relates to toners and development systems for toners.

Digital printers and similar products provide documents that are frequently finished into booklets or folded for mailing in post printing finishing equipment. While the advancement of toners and development systems has been significant, there is still a need to improve the fusing quality of the toner image so that the toner does not smear or "ruboff" in friction fed finishing equipment which could lead to a gray or black smear on the sheet. Also, the toner image, if the proper properties are not present, may noticeably crack when a paper sheet is folded. While many toner fusing systems have excellent image quality, for example, dark solid blacks, the ruboff can be improved. Accordingly, there is a need to provide a process that produces prints with high image and fusing quality thus avoiding the above-described disadvantages.

SUMMARY OF THE PRESENT INVENTION

A feature of the present invention is to provide a development system which provides a printed image having sharp image quality and excellent fusing quality.

Another feature of the present invention is to provide a toner using a development system which provides prints with high image quality and fusing quality.

A further feature of the present invention is to provide methods to reduce ruboff of a printed image and yet maintain image quality.

Additional features and advantages of the present invention will be set forth in part in the description which follows, and in part will be apparent from the description, or may be learned by practice of the present invention. The objectives and other advantages of the present invention will be realized and attained by means of the elements and combinations particularly pointed out in the written description and appended claims.

To achieve these and other advantages and in accordance with the purposes of the present invention, as embodied and broadly described herein, the present invention relates to a development system for toners. The development system includes a supply of dry developer mixture which contains toner particles and hard magnetic carrier particles. The development system further includes a non-magnetic, cylindrical shell for transporting the developer between the supply and the development zone wherein the shell can be rotatable or stationary. A rotating magnetic core of a preselected magnetic field strength and means for rotating at least the magnetic core to provide for the transport of the toner particles from the shell to an electrostatic image are also provided as part of the development system. The development system further includes a fusing roll coated with silicone rubber or other low surface energy elastomers or resins. Preferably, the fusing roll is a filled silicone rubber fusing roller.

The toner used in the development system is preferably a toner containing at least one toner resin, at least one release agent, at least one surface treatment agent, and optionally at least one colorant and/or at least one charge control agent.

The present invention further relates to a method for developing an electrostatic image with the above-described toner. The method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The method further involves transferring the toner to a substrate and the substrate with the toner image is then subsequently fused by passing the toner image on the substrate through a fusing roll to fuse the image on the substrate wherein the fusing roll is a silicone rubber coated fusing roller or is coated with other low surface energy elastomers or resins. The fuser roll is preferably in a pressure contact arrangement with a backup or pressure roll. The dry developer composition contains charged toner particles and oppositely charged carrier particles. Preferably, the carrier particles are a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particles from transferring to the electrostatic image.

The present invention also relates to a developer which contains the above-described toner particles with hard magnetic carrier particles.

It is to be understood that both the foregoing general description and the following detailed description are exemplary and explanatory only and are intended to provide a further explanation of the present invention, as claimed.

DETAILED DESCRIPTION OF THE PRESENT INVENTION

The present invention relates to development systems and methods for developing using certain types of toners. The present invention further relates to the developer used in the development system as well as the toner in the developer.

In more detail, the present invention, in part, relates to a development system. The development system contains a supply of dry developer mixture which includes toner and hard magnetic carrier particles. A non-magnetic, cylindrical shell which can be a stationary shell or a rotating shell is used for transporting the developer mixture from the supply to the development zone. A magnetic core which includes a plurality of magnetic pole portions is arranged around the core periphery in alternating magnetic polarity relation and which is rotatable on an axis within the non-magnetic, cylindrical shell. Furthermore, means for rotating the core and optionally the shell are present in order to deliver the developer mixture to the development zone wherein the toner of the developer is transferred to the electrostatic image.

The development system of the present invention further includes a fuser roll which is coated with a silicone rubber or other low surface energy elastomer or resin. The fuser roll is preferably in a pressure contact arrangement with a backup or pressure roll. In this assembly, both the fuser roll and the pressure roll are pressed against each other under sufficient pressure to form a nip. It is in this nip that the fusing or fixing takes place. The toner particles that are used in the development system preferably contain at least one toner resin, at least one release agent, at least one surface treatment agent, and optionally at least one colorant, at least one charge control agent, other conventional toner components, or combinations thereof. The use of these toner particles in combination with the particular development system described herein results in an image which has improved image quality along with excellent fusing quality.

The set up of the development system is preferably a digital printer, such as a Heidelberg Digimaster 9110 printer using a development station comprising a non-magnetic, cylindrical shell, a magnetic core, and means for rotating the core and optionally the shell as described, for instance, in detail in U.S. Pat. Nos. 4,473,029 and 4,546,060, both incorporated in their entirety herein by reference. The development systems described in these patents can be adapted for use in the present invention. In more detail, the development systems described in these patents preferably use hard magnetic carrier particles. For instance, the hard magnetic carrier particles can exhibit a coercivity of at least about 300 gauss when magnetically saturated and also exhibit an induced magnetic moment of at least about 20 EMU/gm when in an externally applied field of 1,000 gauss. The magnetic carrier particles can be binder-less carriers or composite carriers. Useful hard magnetic materials include ferrites and gamma ferric oxide. Preferably, the carrier particles are composed of ferrites, which are compounds of magnetic oxides containing iron as a major metallic component. For example, compounds of ferric oxide, $Fe_2O_3$, formed with basic metallic oxides such as those having the general formula $MFeO_2$ or $MFe_2O_4$ wherein M represents a mono- or di-valent metal and the iron is in the oxidation state of +3. Preferred ferrites are those containing barium and/or strontium, such as $BaFe_{12}O_{19}$, $SrFe_{12}O_{19}$, and the magnetic ferrites having the formula $MO.6\ Fe_2O_3$, wherein M is barium, strontium, or lead as disclosed in U.S. Pat. No, 3,716,630 which is incorporated in its entirety by reference herein. The size of the magnetic carrier particles useful in the present invention can vary widely, and preferably have an average particle size of less than 100 microns, and more preferably have an average carrier particle size of from about 5 to about 45 microns.

In order to overcome these difficulties, there are several solutions. The most preferred solution of the present invention is to use surface treated toner particles. The surface treatment with a surface treatment agent or a spacing agent reduces the attraction between the toner particles and the hard magnetic carrier particles to a degree sufficient that the toner particles are transported by the carrier particles to the development zone where the electrostatic image is present and then the toner particles leave the carrier particles due at least in part to the sufficient electrostatic forces associated with the charged image. Accordingly, the preferred toner particles of the present invention permit attraction with the magnetic carrier particles but further permit the stripping of the toner particles from the hard magnetic carrier particles by the electrostatic and/or mechanical forces and with surface treatment on the toner particles. In other words, the spacing agent on the surface of the toner particles, as indicated above, is sufficient to reduce the attraction between the toner particles and the hard magnetic carrier particles such that the toner particles can be stripped from the carrier particles by the electrostatic forces associated with the charged image or by mechanical forces.

The preferred spacing agent is silica, such as those commercially available from Degussa, like R-972, or from Wacker, like H2000. Other suitable spacing agents include, but are not limited to, other inorganic oxide particles and the like. Specific examples include, but are not limited to, titania, alumina, zirconia, and other metal oxides; and also polymer beads preferably less than 1 $\mu$m in diameter (more preferably about 0.1 $\mu$m), such as acrylic polymers, silicone-based polymers, styrenic polymers, fluoropolymers, copolymers thereof, and mixtures thereof.

The amount of the spacing agent on the toner particles is an amount sufficient to permit the toner particles to be stripped from the magnetic carrier particles by the electrostatic forces associated with the charged image or by mechanical forces. Preferred amounts of the spacing agent are from about 0.05 to about 2.0 wt %, and more preferably from about 0.1 to about 1.0 wt %, and most preferably from about 0.2 to about 0.6 wt %, based on the weight of the toner.

The spacing agent can be applied onto the surfaces of toner particles by conventional surface treatment techniques such as, but not limited to, conventional mixing techniques, such as tumbling the toner particles in the presence of the spacing agent. Preferably, the spacing agent is distributed on the surface of the toner particles. The spacing agent is attached onto the surface of the toner particles and can be attached by electrostatic forces or physical means or both. With mixing, preferably uniform mixing is preferred and achieved by such mixers as a high energy Henschel-type mixer which is sufficient to keep the spacing agent from agglomerating or at least minimizes agglomeration. Furthermore, when the spacing agent is mixed with the magnetic toner particles in order to achieve distribution on the surface of the toner particles, the mixture can be sieved to remove any agglomerated spacing agent. Other means to separate agglomerated particles can also be used for purposes of the present invention.

In the present invention, at least one release agent is preferably present in the toner formulation. An example of a suitable release agent is one or more waxes. Useful release agents are well known in this art. Useful release agents include low molecular weight polypropylene, natural waxes, low molecular weight synthetic polymer waxes, commonly accepted release agents, such as stearic acid and salts thereof, and others.

The wax is preferably present in an amount of from about 0.1 to about 10 wt % and more preferably in an amount of from about 0.5 to about 5 wt % based on the toner weight. Examples of suitable waxes include, but are not limited to, polyolefin waxes, such as low molecular weight polyethylene, polypropylene, copolymers thereof and mixtures thereof. In more detail, more specific examples are copolymers of ethylene and propylene preferably having a molecular weight of from about 1000 to about 5000 g/mole, particularly a copolymer of ethylene and propylene having a molecular weight of about 1200 g/mole. Additional examples include synthetic low molecular weight polypropylene waxes preferably having a molecular weight from about 3,000 to about 15,000 g/mole, such as a polypropylene wax having a molecular weight of about 4000 g/mole. Other suitable waxes are synthetic polyethylene waxes. Suitable waxes are waxes available from Mitsui Petrochemical, Baker Petrolite, such as Polywax 2000, Polywax 3000, and/or Unicid 700; and waxes from Sanyo Chemical Industries such as Viscol 550P and/or Viscol 660P. Other examples of suitable waxes include waxes such as Licowax PE130 from Clarient Corporation.

The toner particles can include one or more toner resins which can be optionally colored by one or more colorants by compounding the resin(s) with at least one colorant and any other ingredients. Although coloring is optional, normally a colorant is included and can be any of the materials mentioned in *Colour Index,* Volumes I and II, Second Edition, incorporated herein by reference. The toner resin can be selected from a wide variety of materials including both natural and synthetic resins and modified natural resins as disclosed, for example, in U.S. Pat. Nos. 4,076,857; 3,938,992; 3,941,898; 5,057,392; 5,089,547; 5,102,765; 5,112,715; 5,147,747; 5,780,195 and the like, all incorporated herein by reference. Preferred resin or binder materials include polyesters and styrene-acrylic copolymers. The shape of the toner particles can be any shape, regular or irregular, such as spherical particles, which can be obtained by spray-drying a solution of the toner resin in a solvent. Alternatively, spherical particles can be prepared by the polymer bead swelling techniques, such as those described in European Patent No. 3905 published Sep. 5, 1979, which is incorporated in its entirety by reference herein.

Typically, the amount of toner resin present in the toner formulation is from about 80% to about 95% by weight of the toner formulation.

In a typical manufacturing process, the desired polymeric binder for toner application is produced. Polymeric binders for electrostatographic toners are commonly made by polymerization of selected monomers followed by mixing with various additives and then grinding to a desired size range. During toner manufacturing, the polymeric binder is subjected to melt processing in which the polymer is exposed to moderate to high shearing forces and temperatures in excess of the glass transition temperature of the polymer. The temperature of the polymer melt results, in part, from the frictional forces of the melt processing. The melt processing includes melt-blending of toner addenda into the bulk of the polymer.

The polymer may be made using a limited coalescence reaction such as the suspension polymerization procedure disclosed in U.S. Pat. No. 4,912,009 to Amering et al., which is incorporated in its entirety by reference herein.

Useful binder polymers include vinyl polymers, such as homopolymers and copolymers of styrene. Styrene polymers include those containing 40 to 100 percent by weight of styrene, or styrene homologs, and from 0 to 40 percent by weight of one or more lower alkyl acrylates or methacrylates. Other examples include fusible styrene-acrylic copolymers that are covalently lightly crosslinked with a divinyl compound such as divinylbenzene. Binders of this type are described, for example, in U.S. Reissue Pat. No. 31,072, which is incorporated in its entirety by reference wherein. Preferred binders comprise styrene and an alkyl acrylate and/or methacrylate and the styrene content of the binder is preferably at least about 60% by weight.

Copolymers rich in styrene such as styrene butylacrylate and styrene butadiene are also useful as binders as are blends of polymers. In such blends, the ratio of styrene butylacrylate to styrene butadiene can be 10:1 to 1:10. Ratios of 5:1 to 1:5 and 7:3 are particularly useful. Polymers of styrene butylacrylate and/or butylmethacrylate (30 to 80% styrene) and styrene butadiene (30 to 80% styrene) are also useful binders.

Styrene polymers include styrene, alpha-methylstyrene, para-chlorostyrene, and vinyl toluene; and alkyl acrylates or methylacrylates or monocarboxylic acids having a double bond selected from acrylic acid, methyl acrylate, 2-ethylhexyl acrylate, 2-ethylhexyl methacrylate, ethyl acrylate, butyl acrylate, dodecyl acrylate, octyl acrylate, phenylacrylate, methylacrylic acid, ethyl methacrylate, butyl methacrylate and octyl methacrylate and are also useful binders. Also useful are condensation polymers such as polyesters and copolyesters of aromatic dicarboxylic acids with one or more aliphatic diols, such as polyesters of isophthalic or terephthalic acid with diols such as ethylene glycol, cyclohexane dimethanol, and bisphenols.

A useful binder can also be formed from a copolymer of a vinyl aromatic monomer; a second monomer selected from either conjugated diene monomers or acylate monomers such as alkyl acrylate and alkyl methacrylate.

The term "charge-control" refers to a propensity of a toner addendum to modify the triboelectric charging properties of the resulting toner. A very wide variety of optional charge control agents for positive and negative charging toners are available and can be used in the toners of the present invention. Suitable charge control agents are disclosed, for example, in U.S. Pat. Nos. 3,893,935; 4,079,014; 4,323,634; 4,394,430; and British Patent Nos. 1,501,065 and 1,420,839, all of which are incorporated in their entireties by reference herein. Additional charge control agents which are useful are described in U.S. Pat. Nos. 4,624,907; 4,814,250; 4,840,864; 4,834,920; 4,683,188; and 4,780,553, all of which are incorporated in their entireties by reference herein. Mixtures of charge control agents can also be used. Particular examples of charge control agents include chromium salicylate organo-complex salts, and azo-iron complex-salts, an azo-iron complex-salt, particularly ferrate (1-), bis[4-[(5-chloro-2-hydroxyphenyl)azo]-3-hydroxy-N-phenyl-2-naphthalenecarboxamidato(2-)], ammonium, sodium, and hydrogen (Organoiron available from Hodogaya Chemical Company Ltd.).

An optional additive for the toner is a colorant. In some cases the magnetic component, if present, acts as a colorant negating the need for a separate colorant. Suitable dyes and pigments are disclosed, for example, in U.S. Reissue Pat. No. 31,072 and in U.S. Pat. Nos. 4,160,644; 4,416,965; 4,414,152; and 2,229,513, all incorporated in their entireties by reference herein. One particularly useful colorant for toners to be used in black and white electrostatographic copying machines and printers is carbon black. Colorants are generally employed in the range of from about 1 to about 30 weight percent on a total toner powder weight basis, and preferably in the range of about 2 to about 15 weight percent. The toner formulations can also contain other additives of the type used in conventional toners, including magnetic pigments, colorants, leveling agents, surfactants, stabilizers, and the like.

The remaining components of toner particles as well as the hard magnetic carrier particles can be conventional ingredients. For instance, various resin materials can be optionally used as a coating on the hard magnetic carrier particles, such as fluorocarbon polymers like poly (tetrafluoro ethylene), poly(vinylidene fluoride) and polyvinylidene fluoride-co-tetrafluoroethlyene). Examples of suitable resin materials for the carrier particles include, but are not limited to, silicone resin, fluoropolymers, polyacrylics, polymethacrylics, copolymers thereof, and mixtures thereof, other commercially available coated carriers, and the like.

The present invention further relates to methods of forming images using the toners and developers of the present invention. Generally, the method includes forming an electrostatic latent image on a surface of an electrophotographic element and developing the image by contacting the latent image with the toner/developer of the present invention.

The present invention further relates to the use of the above-described development system in developing electrostatic images with the toner of the present invention. The method involves contacting an electrostatic image with the toner of the present invention. For example, the method involves developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which can be rotating or stationary, and controlling the directions and speeds of the core and optionally the shell rotations so that developer flows through the development zone in a direction co-current with the image member movement, wherein an electrographic two-component dry developer composition is preferably used. The dry developer composition contains charged toner particles and oppositely charged carrier particles. The carrier particles are preferably a hard magnetic material exhibiting a coercivity of at least about 300 gauss when magnetically saturated and also exhibit an induced magnetic moment of at least about 20 EMU/gm when in an externally applied field of 1,000 gauss. The carrier particles have a sufficient magnetic moment to prevent the carrier particle from transferring to the electrostatic image. The various methods described in U.S. Pat. Nos. 4,473,029 and 4,546,060 can be used in the present invention using the toner of the present invention in the manners described herein, and these patents are incorporated in their entirety by reference herein.

The electrostatic image so developed can be formed by a number of methods such as by imagewise photodecay of a photoreceptor or imagewise application of a charge pattern on the surface of a dielectric recording element. When photoreceptors are used, such as in high-speed electrophotographic copy devices, the use of half-tone screening to modify an electrostatic image is particularly desirable; the combination of screening with development in accordance with the method of the present invention producing high-quality images exhibiting high Dmax and excellent tonal range. Representative screening methods include those employing photoreceptors with integral half-tone screen, such as those described in U.S. Pat. No. 4,385,823, incorporated in its entirety by reference herein.

The development system of the present invention further includes a fuser roll which is coated with a silicone rubber or other low surface energy elastomer or resin such as tetrafluoroethylene resin. The silicone rubbers which can be used as the surface of the fuser member can be a room temperature vulcanization silicone rubber, a low temperature vulcanization silicone rubber, or a high temperature vulcanization type silicone rubber. The fuser roll can be any shape such as a plate or belt but is preferably cylindrical. Preferably, the fuser roll is composed of a core having coated thereon a thin layer of a silicone rubber. The core may be made of various metals such as iron, aluminum, nickel, stainless steel, and the like or other resilient materials such as various synthetic resins. The core is preferably hollow and a heating element is generally positioned inside the hollow core to supply the heat for the fusing operation. Heating elements suitable for this purpose are known to those skilled in the art and may be a quartz heater made of a quartz envelope having a tungsten resistant heating element disposed internally thereof. The method of providing the necessary heat in the fuser roll is not critical to the present invention and the fuser member can be heated by internal means, external means, or a combination of both. All heating means are well known to those skilled in the art for providing sufficient heat to fuse the toner to the support. The fuser roll is preferably in a pressure contact arrangement with a backup or pressure roll. The pressure roll preferably is a metal core with a layer of a heat-resistant material. In this assembly, both the fuser roll and the pressure roll are mounted on shafts which are biased so that the fuser roll and pressure roll are pressed against each other under sufficient pressure to form a nip. It is in this nip that the fusing or fixing takes place. The quality of the copies produced by the fuser assembly is better when the nip is formed by a relatively hard and unyielding layer with a relatively flexible layer. In this manner, the nip is formed by a slight deformation in the layer due to the biasing of the fuser roll and the pressure roll. The relatively hard and unyielding layer may be made of any well known material such as polyfluoroethylene, propylene, or a silicone rubber, or other similar materials. In the present invention, the fusing occurs when a sheet of a support material such as a sheet of paper bearing thereon a toner image passes between the fuser roll and the pressure roll. The fuser roll then fuses the toner image onto the support material thus forming a printed image on the substrate. With the above-described development system using the particular fuser assembly described herein along with the particular toner formulations described herein, excellent image quality along with good fusing quality is accomplished with respect to the printed image. The excellent image quality can be seen, for instance in the solid area reflection density set forth in the following examples and the good fusing quality can be primarily seen in the ruboff values provided in the following examples as well as the cracked width data provided in the examples. Thus, the present invention provides a means to accomplish a balancing of properties, namely image quality with fusing quality and in a system that provides high speed digital copying in a two component system. The fuser assembly that can be used in the present invention in combination with the particular toner formulations described herein as well as the development system are described in detail in, for instance, U.S. Pat. Nos. 5,534,347, 5,629,061, 3,938,992, 4,046,990, 4,085,702, RE 31,072, 4,810,858, 4,395,109, 6,096,429, 6,067,438, 4,515,884, and 5,595,823. All of these patents are incorporated in their entirety by reference herein.

The various options described in these patents such as the use of a particular silicone rubber or other optional components such as the use of silicone or siloxane oil can be incorporated into the present invention.

Developers in the development system of the present invention are preferably capable of delivering toner to a charged image at high rates and hence are particularly suited to high-volume electrophotographic printing applications and copying applications.

The prints resulting from the development process of the present invention have, as stated above, improved image quality in combination with excellent fusing quality. The printed images when fused on a substrate such as a sheet of paper have improved abrasion resistance, reduced "toner ruboff", even when fed in friction fed finishing equipment. Furthermore, the toner fused image reduced crack widths when the paper sheet is folded as shown, for instance, in the following examples.

As an alternative embodiment, instead of using a spacing agent on the toner particles, the transfer potential can be significantly increased such that the electrostatic forces associated with the charged image are quite high, such as from about 1,000 volts to about 2,500 so that these electrostatic charges are sufficient to strip the toner particles away from the carrier particles.

Another alternative way of using the development system of the present invention is to increase the speed of the rotating magnetic core which permits the shaking of the toner particles to such an extent that their stripping from the carrier particles is possible. The speed of the rotating core is at least about 100 rpm or at least about 500 rpm. With respect to this embodiment, the speed of the rotating magnetic core is at least about 1,000 rpm and can be at least about 2,000 rpm or at least about 2,500 rpm, and more preferably is from about 500 to about 2,500 rpm. These various embodiments described above can be used in various combinations as well.

An additional alternative way of using the development system of the present invention is to add an AC bias in superposition with the DC bias of the toning station. The AC bias agitates the toner particles so that the stripping of toner particles from carrier particles is enhanced. The AC bias waveform preferably has a frequency of from about 300 Hz to about 3000 Hz and peak-to-peak amplitudes of from about 0.2 kV to about 5 kV; and most preferably range from about 1000 to about 1500 Hz, with a 2–3 kV peak-to-peak. AC voltages having the form of a trapezoidal wave and most preferably a square wave are preferable to waveforms with lower average rms voltage, such as sine waves or triangle waves. The usefulness of AC bias as a means of enhancing image density and reducing undesirable side effects of toning in conjunction with toning stations having a rotating magnetic core is described in U.S. Pat. Nos.: 5,376,492; 5,394,230; 5,409,791; 5,489,975; 5,606,404; and 5,985,499. All of the various embodiments described above can be used in various combinations as well.

The present invention can be further clarified by the following examples, which are intended to be purely exemplary of the present invention.

Rub-Off Procedure

The test apparatus for measuring rub-off from an image-bearing substrate having a first side and a second side with a toner image on the first side has a flat surface having a first and second end and adapted to support a first substrate with one of its ends extending beyond the first end of the flat surface (test sheet); a restrainer for preventing movement of the second substrate (receiver sheet) along the length of the flat surface; a pressure pad adapted to impose a selected pressure on the first substrate and the second substrate in a test area; a puller adapted to pull the first substrate a selected distance through the test area relative to the second substrate; a calibrated scanner; and, a computer program for converting the scanned results into a numerical test results. The test sheet is positioned with its first side against the receiver substrate. Any apparatus which is effective to move the image-bearing side of the test sheet an effective distance through a test area relative to the receiver sheet and in contact with the receiver sheet at a selected pressure is suitable.

The substrates tested are typically paper sheets. The test sheet is a paper sheet bearing on its first side a toner image. This sheet is positioned so that one of its ends extends beyond the first end of the flat surface for engagement and removal therefrom. The second sheet is then placed over the first sheet and fastened to restrain its movement relative to the flat surface. A pressure is then imposed on a test area typically near the first end of the flat surface. The first sheet is then pulled from the flat surface and the resulting toner rub-off in the test area is indicative of the rub-off from the test sheet.

Such an apparatus and test procedure are disclosed in U.S. patent application Ser. No. 09/804,863, entitled "Rub-off Test Method and Apparatus," filed Mar. 13, 2001 by John R. Lawson, Gerard Darby II, and Joseph A. Basile, and this application is incorporated in its entirety by reference herein.

The test apparatus is designed to move the test sheet through a test area subject to a test pressure for a selected distance relative to the receiver sheet to determine the rub-off tendencies of the test sheet. It will be understood that the apparatus could operate with the test sheet above the receiver sheet so long as the test sheet is moved relative to the receiver sheet.

The measurement of rub-off is accomplished in two steps. The first step is to abrade the test sheet images on a suitable apparatus. The second step is to take the results of the abrasion test and analyze the results to obtain a quantitative measure of the rub-off characteristics of the test sheet.

The first step of generating the test sheets is accomplished by producing the test sheets on the system to be evaluated. The test prints for rub-off are desirably made up with text printed over the entire imaging area of an 8.5×11 inches sheet. A representative test sheet (target) is prepared. Desirably, the text is written on the test sheet at a suitable angle (i.e., seven degrees) relative to the horizontal. This is to eliminate streaks in the final image where breaks between words exist. In typical use, this target is rendered as a postscript file and sent to the printer. The printer then uses this input file to generate test sheets for evaluation under specific test conditions. Typically a standard paper, such as Hammermill Bond, is used for test-to-test consistency.

Once the test sheets have been made on the printer under study, the evaluation samples are made. These are generated by rubbing the test sheets (Hammermill Bond or any other standard paper) against the receiver sheets in a controlled manner. This control is obtained through the use of the apparatus described above To use the apparatus, the following steps are followed:

1. The test sheet is placed on the flat surface, face up. The sheet is aligned to a registration mark so that the leading edge of the test sheet protrudes beyond the first end of the flat surface.

2. The receiver sheet (second sheet) is placed on the test sheet. The receiver sheet is aligned with the first end of the flat surface. The other end of the receiver sheet is clamped in place.

3. A known weight is then placed in a holder and rests on the paper stack. The weight provides a known pressure on the stack in a test area. In these experiments, 3 PSI was used.

4. The flat surface is then moved laterally until the leading edge of the test sheet engages a roller nip. The rollers turn and "grab" the test sheet and pull it out from under the receiver sheet at 21 inches per second. The relative motion between the test sheet and the receiver sheet causes the toner from the test print to be abraded by the receiver sheet in the test area. This results in a "toner smear" image on the receiver sheet. The level of "smearing" in the test area has been shown to correlate with the subjective measure of rub-off.

5. Steps 1 to 4 are repeated six times. The replicates may be handled in one of two ways. In the first method all six replicates are done with a selected pressure from about 0.5 to about 5 pounds per square inch (PSI). In the second method, two samples are made at each of three pressures, such as 1, 2, and 3 PSI. The differences in the analysis of the two methods are given in the next section.

To analyze the test sheets, the following procedure is followed:

1. Each test area is scanned on a calibrated scanner. The scanner is calibrated as follows:

a) a step tablet of known density is scanned using the same scan conditions as used when the print is scanned;

b) the contrast and zero point of the scanner are adjusted so that the digital values for the step tablets are at a predetermined value, within limits; and, c) the values of the step tablet are periodically checked when doing many scans (e.g., once an hour).

2. With the calibrated scanner, the six images from each test area are scanned. The scan options are selected to give the six scanned test areas sequential names. The scans are 230×230 pixels at 600 dots per inch in grayscale mode. The scanned test area is stored on the file server.

3. The data in the scanned files represent the luminance of the pixels in the scanned area. 0=black and 255=white. For each test area, the standard deviation of the luminance values is calculated. Standard deviation has been shown to provide a measure with a good signal-to-noise ratio that correlates with subjective evaluations of rub-off.

4. If all six test areas were made using the same weight, the standard deviation values for luminance are averaged and the average value is reported as the rub-off for the sample under test.

5. If the six test areas are made using three weights, the six standard deviation values are regressed against the pressures at which they were tested. A least squares regression curve, preferably a second order linear regression, is fit through this data and the estimated values for rub-off at predetermined pressures are calculated. These rub-off values as a function of pressure are the results reported for the test.

6. Confidence limits on the reported values are calculated for both data analysis methods and are typically +/−10% of the rub-off value.

A wide variety of apparatus can be used to maintain a pressure pad bearing a weight to produce the desired pressure in the test area in position. Basically, the pressure pad must be maintained in position so that it can exert the desired pressure on the top of the second sheet while being retained in position relative to the flat surface when either of the sheets is moved. This is can be accomplished by a variety of mechanical configurations. Such variations are obvious to those skilled in the art.

EXAMPLES

Example 1

A toner formulation was made from the following components:

TABLE 1

| Chemical | Trade name | Manufacturer | Weight % |
|---|---|---|---|
| Crosslinked styrene butyl acrylate copolymer | SB77XL | Eastman Kodak | 88.9% |
| Carbon Black | Black Pearls 430 | Cabot Corp | 6.2% |
| Polyethylene wax | Licowax PE130 | Clariant Corporation | 1.8% |
| Iron organic chelate charge control agent | T77 | Hodogaya | 1.3% |
| Acidic organic charge control agent | 2,4-dihydro-5-methyl-2-phenyl-3H-pyrazalone-3-one | Pfaltz and Bauer | 1.8% |

The components were dry powder blended in a 40 liter Henschel mixer for 60 seconds at 1000 RPM to produce a homogeneous blend.

The powder blend was then melt compounded in a twin screw co-rotating extruder to melt the polymer binder and disperse the pigments, charge agents, and waxes. Melt compounding was done at a temperature of 230° F. at the extruder inlet, 230° F. increasing to 385° F. in the extruder compounding zones, and 385° F. at the extruder die outlet. The processing conditions were a powder blend feed rate of 10 kg/hr and an extruder screw speed of 490 RPM. The cooled extrudate was then chopped to approximately ⅛ inch size granules.

After melt compounding, the granules were then fine ground in an air jet mill to a particle size of 11 micron median, volume weighted, diameter. The toner particle size distribution was measured with a Coulter Counter Multisizer. The fine ground toner was then classified in a centrifugal air classifier to remove very small toner particles and toner fines that were not desired in the finished toner. After classification to remove fine particles, the toner had a particle size distribution with a width, expressed as the diameter at the 50% percentile/diameter at the 16% percentile of the cumulative particle number versus particle diameter, of 1.30 to 1.35.

The classified toner was then surface treated with fumed silica. A hyrdophobic silica, designated R972, and manufactured by Nippon Aerosil was used. 2000 grams of toner were mixed with 4 grams of silica to give a product containing 0.2 weight percent silica. The toner and silica were mixed in a 10 liter Henschel mixer with a 4 element impeller for 2 minutes at 2000 RPM.

The silica surface treated toner was sieved through a 230 mesh vibratory sieve to remove un-dispersed silica agglomerates and any toner flakes that may have formed during the surface treatment process.

Example 2

Example 1 was repeated except with different components to a form a toner formulation. In particular, a polyester based toner was prepared by mixing 100 parts of a polyester resin (crosslinked bisphenol A polyester obtained from NexPress) with 8 parts of carbon black (Regal 330 obtained from Cabot Corporation), together with 2 parts of a salicylate salt charge control agent (E84 obtained from Orient Chemical), with 2 parts of polyethylene wax, Polywax 2000 obtained from Baker Petrolite, and 2 parts polypropylene wax, Viscol 550P obtained from Sanyo. The foregoing toner was then subjected to surface treatment using 0.3 parts of a silane-coated fumed silica (R972 obtained from Degussa). The processing conditions were similar to Example 1.

Image Quality Summary:

| Image Quality Attribute | Desired Value | Digimaster 9110 Comparative Example | New styrene acrylic toner Example 1 | New polyester toner Example 2 | Comparative Example* |
|---|---|---|---|---|---|
| Solid area reflection density | 1.35 the higher the better | 1.40 | 1.44 | 1.41 | 1.34 |
| Gloss | 2 | 1.83 | 1.77 | 1.92 | 6.0 |
| Mottle | <800 | 409 | 402 | 413 | 324 |
| Satellites | <2.6 | 1.53 | 1.33 | 1.48 | 1.2 |
| Hollow character | −2.4, the lower the better | −5 | −5 | −5 | −2.8 |

*Soft magnetic carrier and fluorocarbon elastomer fusing system.

Examples 1 and 2 both had overall better image quality than the comparison examples. Examples 1 and 2 had higher reflection density for a maximum solid area density test target, low gloss levels, and printed characters that were free of image voids.

Fusing Quality Summary:

| Image quality attribute | Desired Value | Digimaster 9110 | New styrene acrylic toner | New polyester toner | Comparative Example |
|---|---|---|---|---|---|
| Average crackwidth | <165 the lower the better | 113 | 46 | 6 | |
| 3 PSI "Ruboff" | the lower the better | | | | |
| "Ruboff" on 6% text document | | 10 | 5 | 4 | 6 |
| "Ruboff" on high coverage text document - Guttenberg test target | | 23 | 7.4 | 6.3 | 12 |
| "Ruboff" on text/half toner graphics document | | 17 | 7 | 6 | 10 |
| "Ruboff" from document folding - Baumfolder | the lower the better | | | | |
| 6% coverage text | | 12.3 | 5.6 | 5.3 | 5 |
| Text-half tone image document | | 18.3 | 5.8 | 6.5 | 8.4 |
| High coverage text | | 17.5 | 8 | 8.3 | 7.3 |

Other embodiments of the present invention will be apparent to those skilled in the art from consideration of the present specification and practice of the present invention disclosed herein. It is intended that the present specification and examples be considered as exemplary only with a true scope and spirit of the invention being indicated by the following claims and equivalents thereof.

What is claimed is:

1. A development system for toner comprising:

a supply of dry developer mixture comprising toner particles and hard magnetic carrier particles;

a non-magnetic, cylindrical shell for transporting the developer from said supply to a development zone, wherein said shell is rotatable or stationary;

a rotating magnetic core of a pre-selected magnetic field strength;

means for rotating at least said magnetic core to provide for the transport of said toner particles from said shell to an electrostatic image; and a fuser roll having an elastomer or resin coating on the core of the fuser roll, and said toner particles comprise at least one toner resin, at least one release agent, at least one surface treatment agent, and optionally at least one charge control agent or colorant or both.

2. The development system of claim 1, wherein said core of said fuser roll comprises a metal or a resin.

3. The development system of claim 1, wherein said core is a hollow core and a heating element is located inside the hollow core.

4. The development system of claim 1, wherein said fuser roll is in a pressure contact arrangement with a backup or pressure roll.

5. The development system of claim 4, wherein said fuser roll and said backup or pressure roll are mounted on shafts which are biased so that the fuser roll and pressure roll are pressed against each other under sufficient pressure to form a nip.

6. The development system of claim 1, wherein said surface treatment agent comprises silica.

7. The development system of claim 1, wherein said surface treatment agent comprises at least one metal oxide.

8. The development system of claim 1, wherein said surface treatment agent comprises at least one inorganic oxide.

9. The development system of claim 1, wherein said surface treatment agent comprises at least one polymeric material.

10. The development system of claim 1, wherein said surface treatment agent comprises acrylic polymer, silicone-based polymer, styrenic polymer, fluoropolymer, or mixtures thereof.

11. A method for developing an electrostatic image with toner particles comprising developing an electrostatic image member bearing an electrostatic image pattern by moving the image member through a development zone and transporting developer through the development zone in developing relation with the charge pattern of the moving imaging member by rotating an alternating-pole magnetic core of a pre-selected magnetic field strength within an outer non-magnetic shell, which is rotating or stationary, and controlling the directions and speeds of the core and optionally the shell rotations so that developer flows through the development zone in a direction co-current with the image member movement, transferring said electrostatic image pattern onto a substrate and fusing said electrostatic image on said substrate by passing the substrate through a fuser roll having an elastomer or resin coating on the core of the fuser roll, wherein said developer comprises charged toner particles and oppositely charged hard magnetic carrier particles, and wherein said toner particles comprise at least one toner resin, at least one release agent, at least one surface treatment agent, and optionally at least one charge control agent or colorant or both.

12. The method of claim 11, wherein said method has a developer flow, and said moving imaging member and said developer flow are moving at substantially the same speed.

13. The method of claim 11, wherein said carrier particles comprise hard magnetic material exhibiting a coercivity of at least about 300 gauss when magnetically saturated and also exhibit an induced magnetic moment of at least about 20 EMU/gm when in an externally applied field of 1,000 gauss.

14. The method of claim 11, wherein said toner particles comprise a spacing agent on the surface of said toner particles.

15. The method of claim 14, wherein said spacing agent comprises silica.

16. The method of claim 14, wherein said spacing agent comprises at least one metal oxide.

17. The method of claim 14, wherein said spacing agent comprises at least one inorganic oxide.

18. The method of claim 14, wherein said spacing agent comprises at least one polymeric material.

19. The method of claim 14, wherein said spacing agent comprises acrylic polymer, silicone-based polymer, styrenic polymer, fluoropolymer, or mixtures thereof.

20. The method of claim 14, wherein said spacing agent is present in an amount of from about 0.05 to about 1.5 wt %, based on the weight of the toner.

21. The method of claim 11, wherein said core of said fuser roll comprises a metal or a resin.

22. The method of claim 11, wherein said core is a hollow core and a heating element is located inside the hollow core.

23. The method of claim 11, wherein said fuser roll is in a pressure contact arrangement with a backup or pressure roll.

24. The method of claim 23, wherein said fuser roll and said backup or pressure roll are mounted on shafts which are biased so that the fuser roll and pressure roll are pressed against each other under sufficient pressure to form a nip.

25. The development system of claim 1, wherein said at least release agent comprises at least one wax and said at least one toner resin comprises at least one polyester or at least one styrene acrylic based toner resin.

26. The development system of claim 1, wherein said at least one resin is present in an amount of from about 80% to about 95%, said release agent is present in an amount of from about 0.5% to about 5.0%, and said surface treatment agent is present on the toner particles in an amount of from about 0.05% to about 2.0% , all based on the weight of the toner particles.

* * * * *